US005681630A

United States Patent [19]

Smick et al.

[11] Patent Number: 5,681,630

[45] Date of Patent: Oct. 28, 1997

[54] AIR INTAKE FILTER FOR ELECTRIC APPLIANCES

[76] Inventors: Gary L. Smick, 20030 88th Ave. W., Edmonds, Wash. 98026; Michael L. Kjer, 10802 NE. Sherwood Dr., Vancouver, Wash. 98686; Michael B. Koler, 6028 38th NE., Seattle, Wash. 98115

[21] Appl. No.: 539,425

[22] Filed: Oct. 5, 1995

Related U.S. Application Data

[62] Division of Ser. No. 179,445, Jan. 10, 1994, Pat. No. 5,490,336.

[51] Int. Cl.[6] ..... B32B 3/00

[52] U.S. Cl. ..... 428/40.1; 55/522; 55/524; 55/529; 55/DIG. 42; 428/41.7; 428/42.1; 428/42.2; 428/43; 428/163; 428/167; 428/317.3

[58] Field of Search ..... 428/40.1, 41.7, 428/42.1, 42.2, 43, 163, 167, 317.1, 317.3, 317.5, 317.7, 317.9; 55/529, 524, 522, 496, DIG. 42

[56] References Cited

U.S. PATENT DOCUMENTS

| | | | |
|---|---|---|---|
| 2,808,124 | 10/1957 | Attwood | 183/35 |
| 3,074,609 | 1/1963 | Altshuler | 428/66.5 |
| 3,201,926 | 8/1965 | Harrington | 55/524 |
| 3,418,452 | 12/1968 | Grabner | 219/370 |
| 3,675,402 | 7/1972 | Weed | 55/496 |
| 3,857,016 | 12/1974 | Meyer et al. | 219/368 |
| 4,634,839 | 1/1987 | Gilbertson | 219/373 |
| 5,087,276 | 2/1992 | Snyder | 55/496 |
| 5,188,646 | 2/1993 | Nolen | 55/496 |
| 5,216,822 | 6/1993 | Madiedo | 34/82 |

*Primary Examiner*—Nasser Ahmad

*Attorney, Agent, or Firm*—Hughes, Multer & Schacht

[57] ABSTRACT

Add-on filters for heated-air blowers and other electric motor-powered appliances. The filters are fabricated from a washable, flexible, reticulated foam which traps even minute solid and liquid particles and is adhesively attached to the blower housing. A template, which also serves as a protective cover for the adhesive, has index lines along which a blank of the filter material can be trimmed to size and configured for a particular blower intake.

7 Claims, 4 Drawing Sheets

AIR INTAKE FILTER FOR ELECTRIC APPLIANCES

This application is a divisional of application Ser. No. 08/179,445 filed on Jan. 10,1994 now U.S. Pat. No. 5,490, 336.

TECHNICAL FIELD OF THE INVENTION

The present invention relates to novel, improved devices for protecting air ingesting appliances powered by internally housed electric motors from the deleterious effects of foreign material.

The present invention also relates to the provision of methods for fabricating and installing protective filtration devices of the character just described.

The principles of the present invention can be employed to particular advantages to protect hand held hair dryers (or blow dryers) and similar appliances from the deleterious, service life shortening effects of particles such as hair fragments and drops of hair spray which might otherwise reach internally housed, damage-susceptible operating components of the device through its ambient air intake. The principles of the present invention will be developed primarily with reference to this important and representative application of the invention. The reader is advised, however, that this is being done for the sake of brevity and clarity and is not intended to limit the scope of the invention as defined in the appended claims because the principles of the invention can also be employed to advantage to protect appliances such as drills, sanders, and other power tools from damage by particulate foreign material.

BACKGROUND OF THE INVENTION

Electric motor powered appliances such as blow dryers and other heated-air dryers typically have a much shorter service life than one might expect. This is attributable to the ingestion of foreign particulate material through the blower intake and the consequent abrasion and corrosion of the blower's operating components by the foreign particles. This problem is as old as blow dryers themselves and is present because available blow dryers either have no mechanism at all for filtering particles from the incoming air or, at best, a rudimentary and ineffective, particle-trapping screen or an equally ineffective filter woven or otherwise fabricated from elongated filaments. Of this character are the screens and filters disclosed in U.S. Pat. Nos.: 3,418,452 issued 24 Dec. 1968 to Grabner; 4,634,839 issued 6 Jan. 1987 to Gilbertson; 3,857,016 issued 24 Dec. 1974 to Meyer et al.; and 5,216,822 issued 8 Jun. 1993 to Madiedo.

The screens and filters disclosed in this just-cited patents and others of the same, currently available character are at best capable of trapping gross particles such as large pieces of hair and lint. Dust particles, small fragments of hair, hair spray droplets, and other minute particles readily pass through these prior art screens and filters; and it is the smaller particles which are most apt to penetrate into the working components of the appliance and cause the damage leading to shortened service life.

One might expect that aftermarket or replacement filters capable of trapping those small particles most apt to damage the working components of a heated-air blower would be available. That they are not is believed to be attributable to the cost of manufacturing and stocking the large number of different filters that would be required to outfit the variety of hand held blowers currently available in the marketplace and to the lack of a filtration device having a universal character making it compatible with the different hair dryers that are currently in use and available for purchase.

Consequently, there has been a continuing need which currently persists for a filter which is: (a) effective to trap minute as well as gross particles without unexceptably impeding the flow of air through a heated-air blower or other appliance; and (b) a filtration device of that character which is universally adaptable to currently used and marketed blowers as well as those which may become available in the future.

SUMMARY OF THE INVENTION

Filters which meet these needs in that they effectively trap even minute particles without unduly restricting air flow and in that they are universally adaptable have now been invented and are disclosed herein.

In blow dryer applications, these filters also advantageously keep the user's hair from being sucked into the blower intake in those cases where the user has long hair.

The filters of the present invention are structurally integral, stable, reticulated foams of appropriate thickness. A blank of the foam is supplied with a detachable template having a set of concentric index lines. If necessary, the blank can be cut along the appropriate one of these lines to fit it to a particular blower intake.

Alternatively, the template and blank can be die cut along the concentric index lines, leaving adjacent annular segments of the blank connected only at intervals around the circumference of the blank. The material bridging the annular segments at these locations can be easily ruptured. This allows an outer segment to be easily removed, again to size the blank to fit a particular blower intake.

One advantage of this alternate construction is that the die cut edges are neater than those typically obtained by cutting the blank to size with scissors. Also, some may find this "pull-apart" technique for removing excess material more convenient than cutting the blank.

The profile of many hand held blowers is flat. Others, however, have a spheroidal or oblate configuration. With the latter type of intake configuration in mind, the template also has complementary, converging guidelines which meet at the center of the blank. Cutting through the blank material along these lines allows a wedge to be cut from the blank. The blank can then be formed into a conical configuration fittable over an oblate air intake.

Another feature of the novel filters disclosed herein is the ease with which they may be attached to the blower. All this requires is that one: (a) peel off a protective cover, exposing an adhesive applied to one side of the filter, and then (b) press the filter onto the blower over its ambient air intake. Typically, the concentric and converging index lines (or guidelines) discussed above will be printed or otherwise put on the exposed surface of the protective cover, the latter therefore also serving as the filter template.

An alternate approach can be, and preferably is, employed in applications of the present invention involving those blowers with detachable caps or grills giving access to the interior of the blower intake. Here, the grill is removed and the existing, ineffective, wire screen or filamentary filter discarded and replaced with one cut as necessary with the technique discussed above from a blank of the filter material. The grill or cap is then replaced to complete the installation process.

The objects, features, and advantages of the present invention will be apparent to reader from the foregoing and the appended claims and as the ensuing detailed description and discussion proceeds in conjunction with the accompanying drawings.

DETAILED DESCRIPTION OF THE INVENTION

Figure 1:
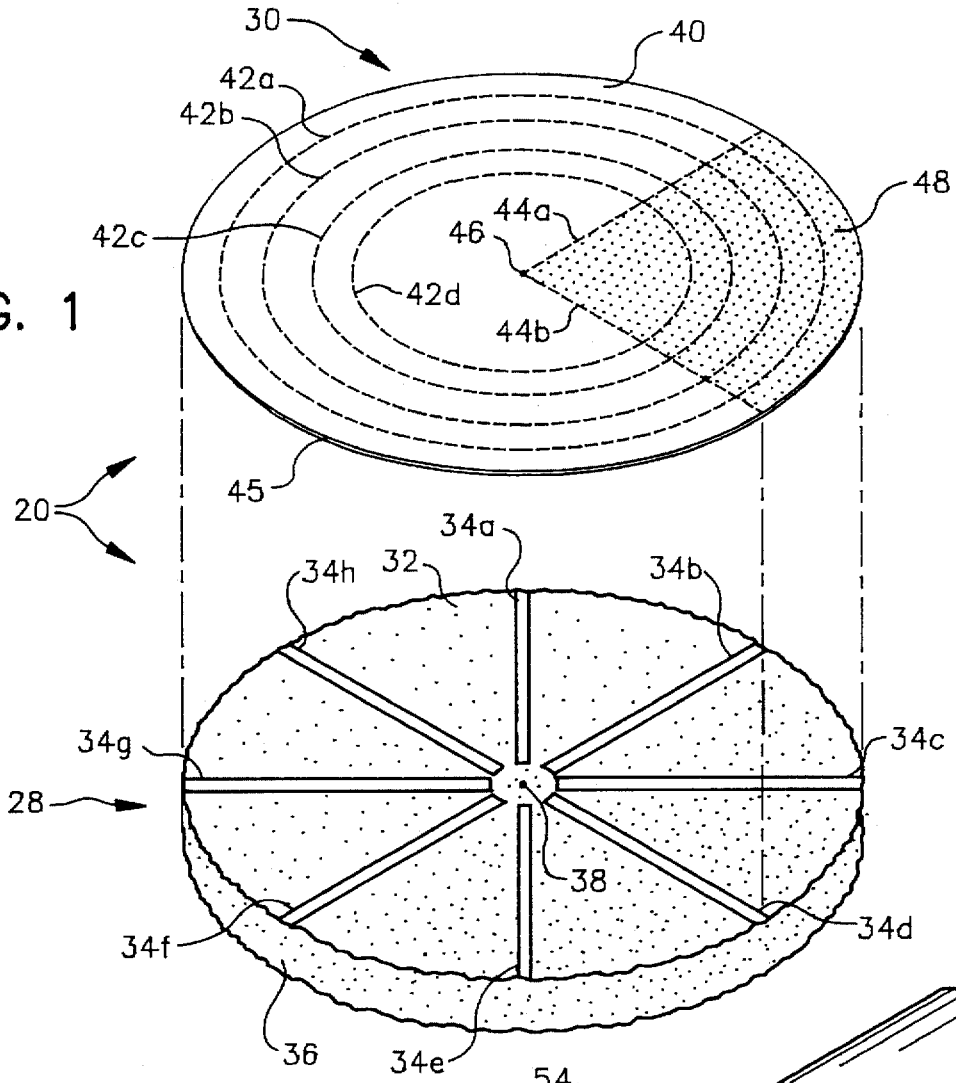
FIG. 1 is an exploded view of a filter material blank and an associated template for cutting that blank to size or size and shape to fit a particular heated-air dryer in accord with the principles of the present invention.
Figure 2:
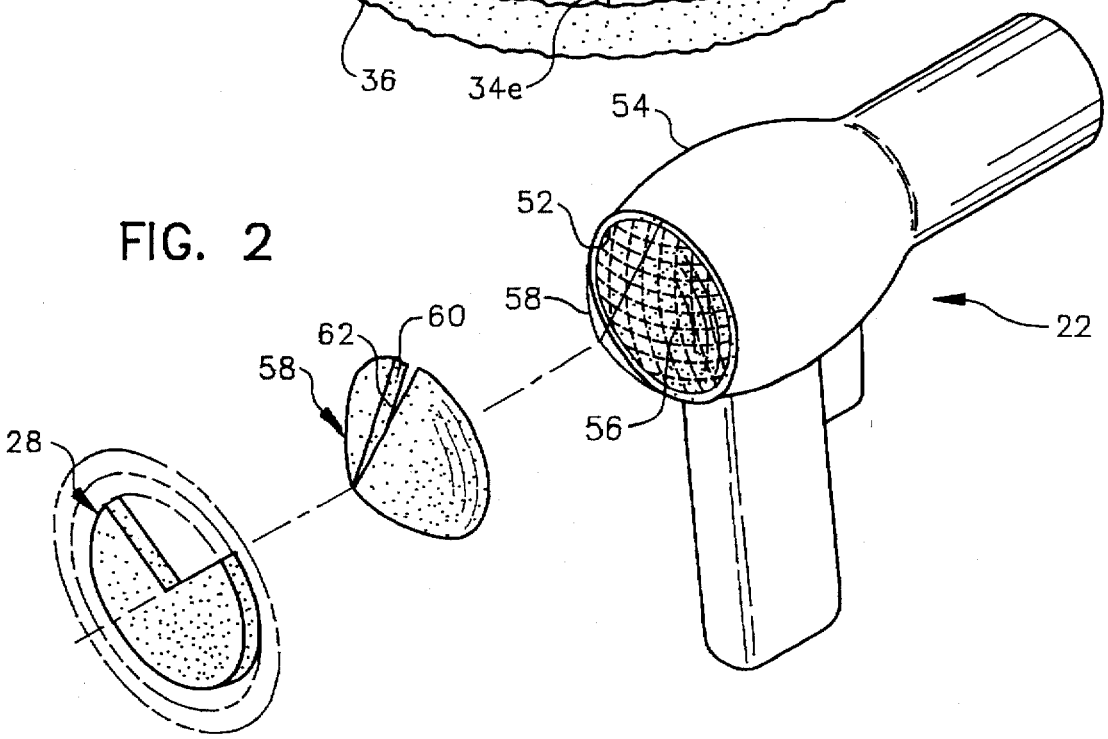
FIG. 2 is an exploded view showing the blank cut to size with a wedge removed so that the blank can be formed into a conical configuration for a heated-air dryer with an oblate air intake; this figure also shows the dryer with the filter installed.
Figure 3:
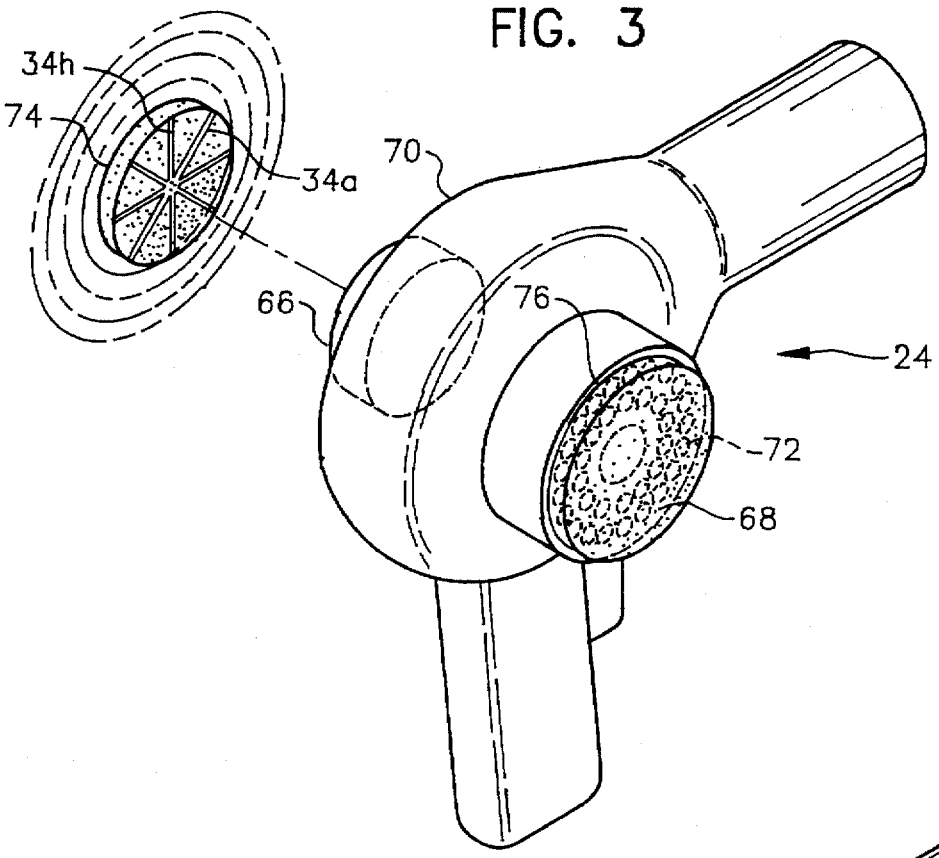
FIG. 3 is an exploded view showing a filter cut from a blank of the FIG. 1 character for installation over a heated-air blower intake with a flat profile; this figure also shows a filter as just described in place on a second intake of the same blower.
Figure 4:
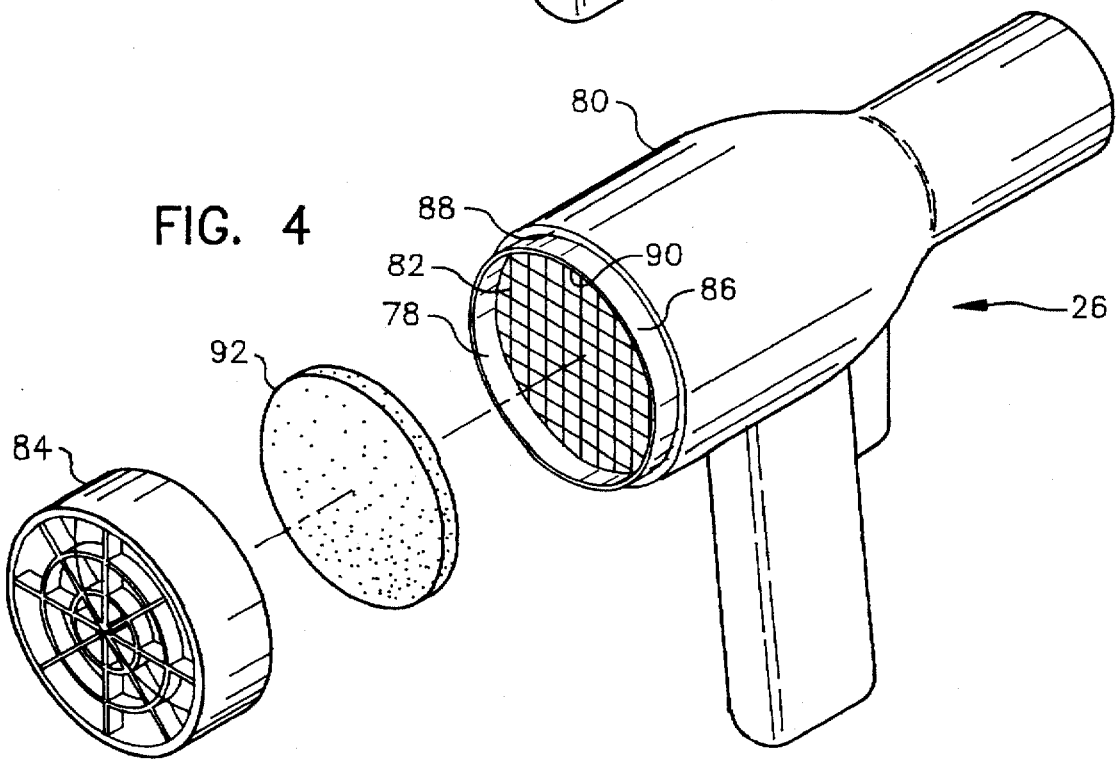
FIG. 4 is yet another exploded view, in this case depicting the installation of a filter embodying the principles of the present invention in the intake of a heated-air dryer with a removable grill.

Referring now to the drawings, FIGS. 1 and 2 depict an assembly or product 20 which can be employed to provide a filter capable of trapping particulate material in the ambient air ingested through the intake of a heated-air blower such as one of the hand-held hair dryers depicted in FIGS. 2, 3, and 4 and identified by reference characters 22, 24, and 26, respectively.

The major components of filter-forming assembly 20 are a circular blank 28 of filter material and a separate template 30 for cutting the blank, if and as necessary, to a size and configuration appropriate for a particular blower intake. Blank 28 will typically be on the order of three-eighths inch thick.

The preferred filter material is supplied by Peakhi Company. This material is a flexible, reticulated foam made from a precursor with the following formulation:

| Constituent | Weight Percent |
|---|---|
| Polypropylene Glycol | 64.99 |
| Toluene Di-isocyanate 80/20 | 33.12 |
| Silicon Surfactant | 0.65 |
| Amine (Niax catalyst) | 0.07 |
| Stannous Octate | 0.17 |

This representative and preferred foam has a density of 23±2 kilograms per cubic centimeter and 20±4 pores per square millimeter of surface area. The material offers minimal resistance to the flow of air; at the same time it is capable of trapping minute particles of both solids and liquids. Filters made from it can be washed and reused.

Applied to one side 32 of blank 28 is a set of radial, equiangularly spaced lines of adhesive 34*a*–34*h*. These lines of adhesive extend inwardly from the periphery 36 of the blank and terminate just short of that component's center 38. Any appropriate pressure sensitive adhesive may be employed; and the adhesive may be applied by spraying or rolling through a stencil or another of the techniques commonly employed to apply pressure sensitive adhesives.

Referring still to FIG. 1, template 30 is a flexible piece of material such clear acetate film or the release paper available from 3M Corporation. The acetate is typically used as it allows the filter material blank to be observed during, and thereby facilitates, the manufacturing process. It has the same diameter as blank 28.

Printed or otherwise provided on one side 40 of the template is a set of concentric, circular index lines 42*a*–42*d* and a pair of converging, rectilinear index lines 44*a* and 44*b*. Index lines 44*a* and 44*b* extend inwardly from the periphery 46 of the template to the center 48 of that component.

Template 38 is detachably fixed to the surface 32 of blank 28 in axial alignment with the blank by the lines of adhesive 34*a*–34*h* on that surface. Blank 28 may be cut along an appropriate one of the circular index lines 42*a*–42*d* to match the diameter of the blank to that of the air intake which a particular blower has. Also, blank 28 may be cut along converging index lines 44*a* and 44*b* to remove a wedge 48 of material from the blank. This allows the blank to be formed into a conical configuration so that it will fit over a blower intake of spheroidal or oblate configuration.

Referring still to the drawings, the blower 22 illustrated in FIG. 2 is characteristic of those with an oblate air intake. That intake—identified by reference character 52—is located in the rear end of the blower housing 54 and given the oblate configuration just described by a conventional, ineffective screen or grid 56.

In accord with the principles of the present invention, the internal operating components of dryer 22 are protected against damage, and the service life of the blower extended, by enveloping air intake 52 with a filter 58 capable of trapping both large particles of foreign material and those very small particles which are most apt to cause damage if they reach the interior of blower housing 54.

As is shown in FIG. 2, filter 58 is formed from blank 28 by first cutting the blank along one of the circular index lines 42*a*–42*d* to a diameter appropriate for blower intake 52. Next, the blank is cut along the two converging index lines 44*a* and 44*b*, and wedge 48 is removed. Next, template 30 is peeled off, exposing adhesive lines 34*a*–34*h*. Blank 28 is then oriented with the lines of adhesive facing blower intake 52; and the radially oriented edges 60 and 62 produced by cutting the blank along converging index lines 44*a* and 44*b* are brought together, forming the blank into the illustrated conical filter 58. The filter is pressed against the rear end of blower housing 54 to affix it to that housing over air intake 52. Thereafter, all air reaching the interior of blower housing 54 is obliged to pass through filter 58, trapping even the minute particles present in that air and preventing them from reaching the interior of the blower housing and abrading, corroding, or otherwise damaging its operating components.

It is preferred, in this respect, that guidelines 44*a* and 44*b* be located at apposed sides of strips of adhesive such as the facing sides 64*a* and 64*b* of the illustrated strips 34*b* and 34*d*. The strips of adhesive are consequently left intact if blank 28 is cut along index lines 44*a* and 44*b* so that wedge 48 can be removed and the blank formed into a conical filter. This ensures that filter blank edges 60 and 62 are adhesively bonded to blower housing 54. As a result, the edges 60 and 62 are kept from gaping apart, which would be unsightly and, of perhaps greater importance, allow unfiltered air to reach the operating components of blower 22.

Referring still to the drawings, the blower 24 illustrated in FIG. 3 is also of a conventional configuration. This blower has air intakes 66 and 68 located on opposite sides, and toward the rear, of blower housing 70. Air intakes 66 and 68 have flat profile grills which are conventionally structured and capable of trapping only gross particles such as pieces of lint and large fragments of hair. One of these grills is shown in FIG. 3 and identified by reference character 72.

To protect a blower of the character illustrated in FIG. 3 from damage by foreign material in accord with the principles of the present invention, filters 74 and 76 are made by trimming two blanks of the character illustrated in FIG. 1 and identified by reference character 28 along the appropriate circular index line 42*a*–42*d* if necessary to match the filter and air intake sizes. Filters 74 and 76 are then oriented with the lines 34*a*–34*h* of adhesive facing blower housing 70 and the templates 30 removed. Then, the filters are pressed against housing 70 to fix them in place over air intakes 66 and 68.

As mentioned briefly above, there are hair dyers and other heated-air blowers which have: (a) an internal screen or filter for trapping gross particles, and (b) an air intake cap or grill which can be removed to clean that screen or filter. It was also pointed out above that the operating components of such blowers can be protected against damage with filters employing the principles of the present of the present invention.

The heated-air blower 26 illustrated in FIG. 4 is one of the character just described. An air intake 78 is formed in the rear end of that dryer's housing 80. A screen 82 for trapping large particles is permanently mounted in intake 78; and the intake is covered with a detachable grid 84 which slides over the rear end 86 of the blower housing 80 and seats against a ledge 88.

Certain of the blowers of the character just described have a removable, large pore filter in the cavity 90 at the rear end of air intake 78. The present invention is practiced by first removing grill 84 and discarding any such filters that might be present. A filter 92 embodying the principles of the present invention is then cut from filter material of the character disclosed above to an appropriate diameter (if necessary) and installed in air intake cavity 90. Cap 84 is then replaced to complete the process.

Figure 5:
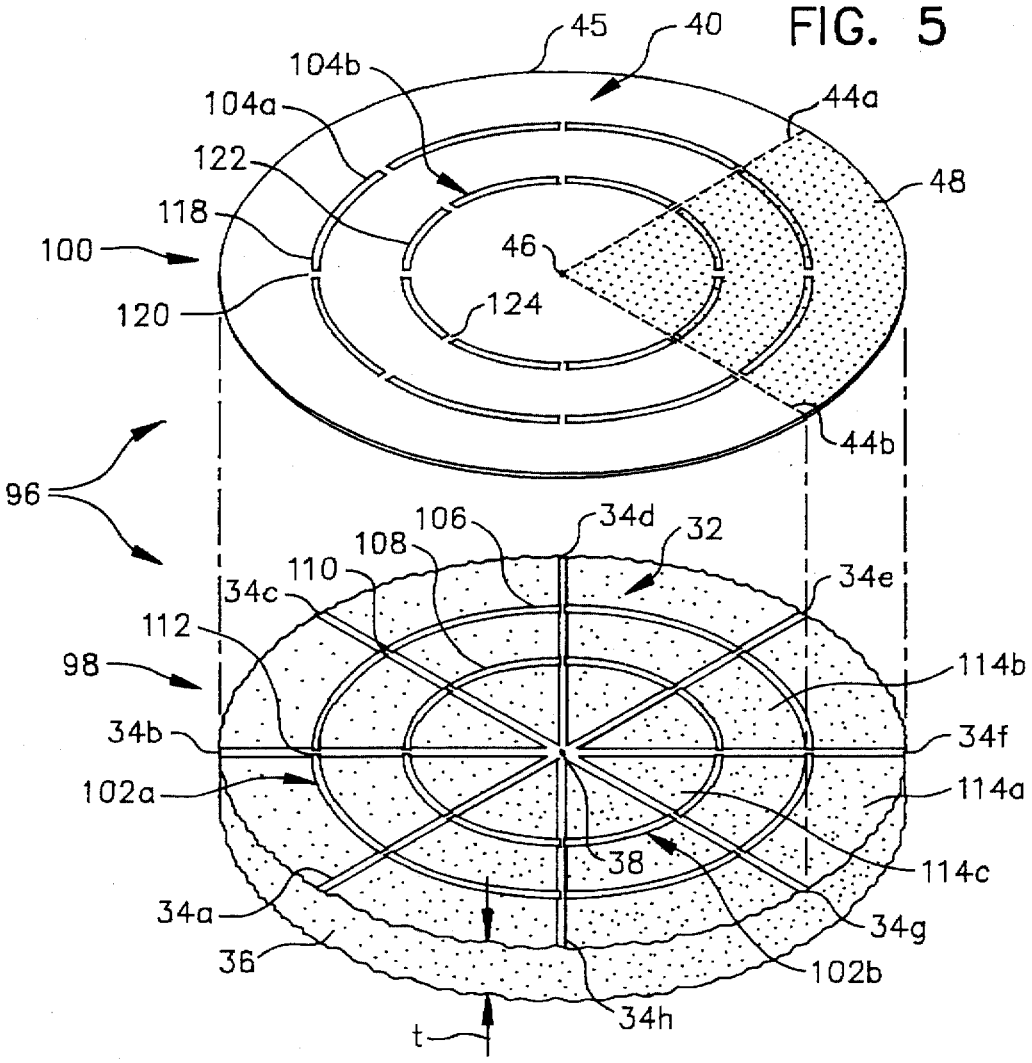
FIG. 5 is a view similar to FIG. 1 of another blank for filters embodying the principles of the present invention and a template for sizing that blank to fit an air intake of particular size.

Referring still to the drawings, FIG. 5 depicts a filter blank/template assembly 96 differing from the assembly of that character described above and illustrated in FIG. 1 primarily in that the filter blank 98 and template 100 of the assembly are die cut along: (a) concentric, circular index lines 102*a* and 102*b* of the blank; and (b) the complementary, also circular and concentric index lines 104*a* and 104*b* of template 100. More specifically, blank 98 is cut entirely through its thickness t in each of the equally dimensioned and spaced, arcuate segments 106 and 108 around circular guidelines 102*a* and 102*b*, respectively. Arcuate gaps or segments 106 and 108 are separated by uncut bridges or links 110 and 112. These links hold together the annular segments 114*a*–114*c* of the blank formed by die cutting them along guidelines 102*a* and 102*b*.

Blank 96 may be made of the same materials as are employed to fabricate blank 28, and these materials may be used in the same thicknesses. Those elements of the FIGS. 1 and 5 filter blanks and templates which are alike have been identified by the same reference characters.

Figure 6:
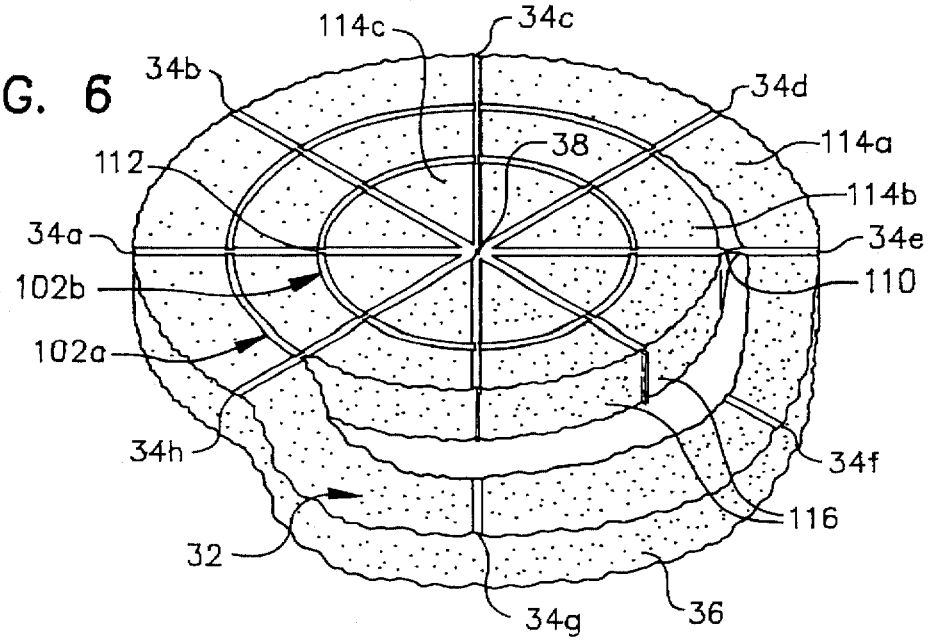
FIG. 6 is a perspective view of the filter blank shown in FIG. 5 with an outer annular segment in the process of being removed to produce a filter of the size needed to complement an appliance air intake.
Figure 7:
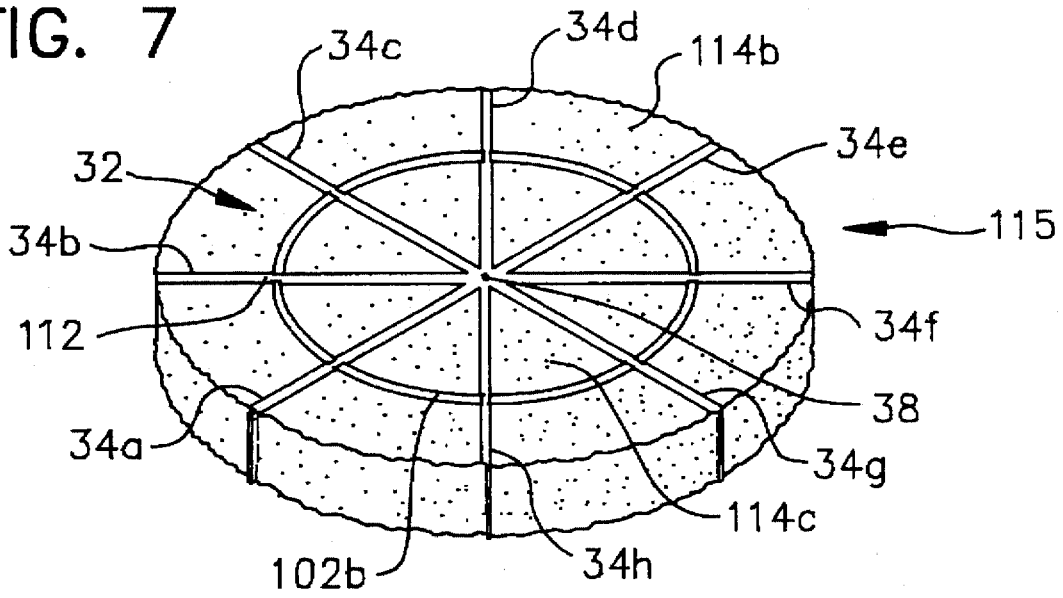
FIG. 7 is a perspective view of the filter.

Blank 98 is sized to fit a particular appliance air intake such as the intake 52 of blow dryer 22 or an intake 66 or 68 of blower dryer 24 by rupturing the links 110 between the outer and adjacent filter blank segments 114*a* and 114*b* to separate the outer segment from the blank as shown in FIG. 6 to form a filter 115 as shown in FIG. 7 or by rupturing the links 112 along inner circular guideline 102*b* to remove the two outer segments 114*a* and 114*b* from innermost filter blank segment 114*c* and form a filter (not shown) with a smaller diameter equalling the diameter of segment 114*c*.

This novel technique for sizing filter blank 96 is advantageous in that die cut edges such as the representative ones identified by reference character 116 in FIG. 6 are smooth and more aesthetically pleasing than the ragged edge that might be left in using scissors to cut a blank to size, and some may find this technique more convenient than cutting the blank to size with scissors.

Referring again to FIG. 5, the complementary template 100 of assembly 96 is die cut along guidelines 104*a* and 104*b* in the same fashion—and typically at the same time—that blank 98 is die cut in the manner just described. The die cut template segments around the outer guideline 104*a* and the links or bridges between those segments are identified by reference characters 118 and 120 and the die cut segments and links around inner guideline 104*b* by reference characters 122 and 124, respectively.

The invention may be embodied in many forms without departing from the spirit or essential characteristics of the invention. The present embodiments are therefore to be considered in all respects as illustrative and not restrictive, the scope of the invention being indicated by the appended claims rather than by the foregoing description; and all changes which come within the meaning and range of equivalency of the claims are therefore intended to be embraced therein.

What is claimed is:

1. An air filter precursor product from which air filters compatible with a variety of electric motor powered appliances having an ambient air intake can be created, said product comprising:

a flat blank fabricated from a particulate trapping filter material;

a removable template means providing concentric circular index lines along which said blank can be cut to size the blank for a particular appliance air blower intake and converging index links oriented to extend inwardly from the periphery of the blank to the center thereof and along which said blank can be cut to remove a wedge from the blank and allow it to be configured into a cone complementing a rounded air intake; and adhesive means on one side of the blank for attaching a filter made from the blank to an appliance in overlying relationship to an air intake of said appliance, said template means being removably secured to said flat blank by said adhesive means.

2. A product as defined in claim 1 in which the filter material is a reticulated foam with circa 20±4 pores per square millimeter of surface area.

3. A product as defined in claim 1 in which the filter material is a reticulated foam prepared from a precursor in which the major constituents are propylene glycol and toluene di-isocyanate.

4. A product as defined in claim 1 in which the blank is cut through along spaced segments of lines corresponding to the concentric index lines on the template means, leaving links of material which can be ruptured to allow an annulus of material of selected width to be removed from the blank and the blank thereby sized to fit the particular appliance air intake.

5. An air filter precursor product from which air filters compatible with a variety of electric motor-powered appliances having an ambient air intake can be created, said product comprising:

a flat blank fabricated from a particulate trapping filter material;

means providing concentric circular index lines along which said blank can be cut to size the blank for a particular appliance air blower intake and converging index lines oriented to extend inwardly from the periphery of the blank to the center thereof and along which said blank can be cut to remove a wedge from the blank and allow it to be configured into a cone complementing a rounded air intake; and adhesive means on one side of the blank for attaching a filter made from the blank to an appliance in overlying relationship to an air intake of said appliance, said adhesive means comprising a set of radially oriented strips of pressure-sensitive adhesive extending from the perimeter toward the center of the blank, said means providing index lines being removably secured to said flat blank by said adhesive means.

6. An air filter precursor product from which air filters compatible with a variety of electric motor-powered appliances having an ambient air intake can be created, said product comprising:

a flat blank fabricated from a particulate trapping filter material;

means fabricated from a clear, polymeric, sheet material providing concentric circular index lines along which said blank can be cut to size the blank for a particular appliance air blower intake and converging index lines oriented to extend inwardly from the periphery of the blank to the center thereof and along which said blank can be cut to remove a wedge from the blank and allow it to be configured into a cone complementing a rounded air intake; and adhesive means on one side of the blank for attaching a filter made from the blank to an appliance, said sheet material means being removably secured to said flat blank by said adhesive means in overlying relationship to an air intake of said appliance.

7. A product as defined in claim 5 in which the converging index lines on the template are so located relative to complementary strips of adhesive on the filter blank that said cutting of the blank along those lines of adhesive leaves said strips of adhesive intact.

* * * * *